US012006631B2

(12) United States Patent
Jancic et al.

(10) Patent No.: US 12,006,631 B2
(45) Date of Patent: Jun. 11, 2024

(54) DEVICE AND METHOD FOR PRODUCING A FIBROUS WEB

(71) Applicant: ANDRITZ AG, Graz (AT)

(72) Inventors: Boris Jancic, Sladki Vrh (SI); Lukas Gissing, Gratwein-Strassengel (AT); Stefano Marenco, Pinerolo (IT); Klaus Gissing, Gratwein-Strassengel (AT)

(73) Assignee: ANDRITZ AG, Graz (AT)

( * ) Notice: Subject to any disclaimer, the term of this patent is extended or adjusted under 35 U.S.C. 154(b) by 0 days.

(21) Appl. No.: 17/790,828

(22) PCT Filed: Dec. 1, 2020

(86) PCT No.: PCT/EP2020/084043
§ 371 (c)(1),
(2) Date: Jul. 5, 2022

(87) PCT Pub. No.: WO2021/151559
PCT Pub. Date: Aug. 5, 2021

(65) Prior Publication Data

US 2023/0030264 A1 Feb. 2, 2023

(30) Foreign Application Priority Data

Jan. 30, 2020 (AT) ..... A 50071/2020

(51) Int. Cl.

| | |
|---|---|
| ***D21F 9/00*** | (2006.01) |
| ***D21F 1/02*** | (2006.01) |
| ***D21F 1/10*** | (2006.01) |
| ***D21F 3/02*** | (2006.01) |
| ***D21F 3/10*** | (2006.01) |
| ***D21F 7/08*** | (2006.01) |

(52) U.S. Cl.
CPC ..... *D21F 9/003* (2013.01); *D21F 1/02* (2013.01); *D21F 1/10* (2013.01); *D21F 3/0272* (2013.01); *D21F 3/10* (2013.01); *D21F 7/08* (2013.01)

(58) Field of Classification Search
CPC ... D21F 9/003; D21F 1/02; D21F 1/10; D21F 3/0272; D21F 3/10; D21F 7/08; D21F 1/32; D21F 11/14; D21F 3/0209; D21F 5/04; D21F 9/04; D21F 11/00; D21F 1/105
See application file for complete search history.

(56) References Cited

U.S. PATENT DOCUMENTS

| | | | | |
|---|---|---|---|---|
| 5,306,395 | A * | 4/1994 | Myren | D21F 11/145 162/290 |
| 5,397,437 | A | 3/1995 | Myren | |
| 9,347,180 | B2 | 5/2016 | Silva et al. | |
| 10,808,360 | B2 * | 10/2020 | Anzel | D21F 7/083 |
| 2019/0360155 | A1 * | 11/2019 | Anzel | D21F 9/003 |

OTHER PUBLICATIONS

International Search Report mailed Mar. 12, 2021 for International Patent Application No. PCT/EP2020/084043.

* cited by examiner

*Primary Examiner* — Jacob T Minskey
*Assistant Examiner* — Matthew M Eslami
(74) *Attorney, Agent, or Firm* — Alix, Yale & Ristas, LLP

(57) ABSTRACT

A device and a method for producing a pulp web in which the first clothing and the second clothing are wrapped partly round the forming roll and another roll. The pulp web formed is guided between the forming roll and the other roll on the first clothing and the second clothing is guided separately from the first clothing, at least in one section. This enables the pulp web to be produced with low energy consumption and operating costs.

12 Claims, 5 Drawing Sheets

DEVICE AND METHOD FOR PRODUCING A FIBROUS WEB

BACKGROUND

The invention relates to a method for producing a pulp web, especially a tissue or sanitary paper web, in which a pulp suspension is fed through a headbox and placed between a first revolving clothing designed as a felt and a second revolving clothing designed as a forming fabric and dewatered by centrifugal force in the area of a forming roll in order to form the pulp web, the first and second clothings being wrapped partly round the forming roll, the first clothing being guided between the forming roll and the second clothing, the first and second clothings being wrapped partly round another roll, and the first clothing being guided between the other roll and the second clothing. The invention also relates to an associated device for producing a pulp web.

In general, a pulp suspension is fed through a headbox and placed between two clothings in order to produce a pulp web, especially a tissue or sanitary paper web, the two clothings being wrapped partly round a forming roll and the pulp suspension being dewatered by centrifugal force in the area of the forming roll. The crescent former design is used, in particular, in the production of tissue, i.e. the pulp suspension is placed between a felt and a forming fabric, the pulp web being formed by dewatering of the pulp suspension. By definition, the crescent former design means that the felt is disposed between the forming fabric and the forming roll. When the pulp web has formed, the forming fabric is lifted off the pulp web, the pulp web resting on the felt when it is fed to the next process steps, comprising other mechanical and/or thermal dewatering processes and winding on a reel as the final product.

WO 2017/060053 A1 discloses a method for producing a pulp web, characterized in that the pulp web is guided over a suction roll together with the forming fabric and the felt immediately after the forming roll. This provides a tissue-making process that produces tissue of the highest possible quality.

DE 10 2011 007 568 A1 describes a device and method to produce a material web, which method is characterized in that a permeable press belt is brought into contact with the pulp web in a press zone. This achieves greater flexibility for the production of different paper grades.

SUMMARY

The herein embodiments allow production of a pulp web, with low energy consumption, low operating and investment costs and, at the same time, improved quality properties in the pulp web.

According to the disclosure, this is achieved in that the pulp web formed is guided on the first clothing between the forming roll and the other roll, the second clothing being guided separately from the first clothing, at least in a section between the forming roll and the other roll. In centrifugal dewatering of the pulp web in the area of the forming roll, the fibrous material from the pulp suspension is largely retained on the second clothing, the liquid from the pulp suspension—normally water or process water—being discarded through the second clothing. However, this results in the second clothing being saturated with water and in a high water load in the second revolving clothing. According to the inventive embodiments, the second revolving clothing is guided separately from the first clothing, at least in a section between the forming roll and the other roll, it also being possible to lift the second revolving clothing off the first revolving clothing while on the forming roll and not place the second revolving clothing on the first revolving clothing again until they reach the other roll. By lifting the second revolving clothing off the first revolving clothing, the pulp web formed being guided on the first clothing, a means emerges with which to condition the second revolving clothing and, in particular, to reduce the water load in the second clothing guided separately. In addition, by lifting the second clothing off, more effective means of conditioning the second clothing emerge because there is no risk of any damaging effect on the pulp web formed and guided on the first clothing. An advantageous conditioning procedure for the second revolving clothing comprises the following steps: Cleaning of the second revolving clothing using a high-pressure shower after the second revolving clothing has been lifted off the first revolving clothing, optional reduction of the water load in the separately guided second clothing by means of a suction box, reduction of the water load in the separately guided second clothing by means of a device for dispersing a fluid, and optional further reduction of the water load in the separately guided second clothing by means of a suction box. A specialist will identify compressed air nozzles, slotted nozzles and air blades as obvious devices for dispersing a fluid. It would make sense to use air, compressed air, hot air, process air, etc., as the fluid. Advantageously, the fluid should have 0.1-2.0 bar pressure. The conditioned, second revolving clothing is then placed on the first clothing again in an area before the other roll or directly at the other roll. The pulp web can then be further dewatered advantageously in the area of the other roll. It is also feasible that the other roll has a diameter that is smaller than the diameter of the forming roll, which would result in increased centrifugal dewatering at the other roll compared to dewatering at the forming roll, or that the other roll is designed as a suction roll.

A favourable embodiment is thus characterized in that the first clothing is guided over the other roll, designed as a suction roll. It is a particular advantage if a vacuum in the region of 2-6 MWC is applied through the suction roll. In the production of a pulp web, especially a tissue web, it is favourable if the first revolving clothing is a felt and the second revolving clothing is a forming fabric. Here, the pulp web formed usually tends to follow the felt, i.e. when the forming fabric is lifted off the felt, the pulp web formed will follow the felt, meaning that, according to the disclosure, the pulp web formed follows the first clothing between the forming roll and the other roll. Designing the other roll as a suction roll enables increased dewatering of the web formed in the area of the other roll. Dewatering of the web formed is improved by the suction roll if the forming fabric is guided separately from the felt, at least in a section between the forming roll and the suction roll. This applies in particular if the forming wire is conditioned in this section, and the water load of the forming wire guided separately is reduced.

Another favourable embodiment is characterized in that hot air and/or steam is applied to the forming fabric in the area of the suction roll, the suction roll drawing in the hot air and/or steam by suction through the forming fabric in the direction of the pulp web. Applying hot air and/or steam results in a temperature increase in the pulp web to be dewatered and to a temperature increase in the water contained in the pulp web and the clothings. The viscosity of the water drops as a result of the increase in temperature. Reduced viscosity is advantageous in terms of the dewaterability of the pulp web. It makes sense to use exhaust process air, e.g. exhaust air from the thermal drying device, for example a Yankee hood. Hot air in a temperature range of 120° C. to 200° C. and with a moisture load between 0.2 kg/kg and 0.7 kg/kg and/or steam in a pressure range of 0.2-2.0 bar overpressure are preferred.

An advantageous design is characterized in that the second clothing leaves the forming roll first and then the first clothing and the pulp web on it leave the forming roll, the second clothing being lifted off the pulp web guided on the first clothing. In this way, the second clothing is lifted off the first clothing at the earliest possible point, thus preventing further re-wetting of the web formed.

Another favourable embodiment is characterized in that a water load in the separately guided second clothing is reduced in the section between the forming roll and the other roll. By reducing the water load of the second clothing in this section and placing the second clothing on the first clothing afterwards, the web formed being guided between the first clothing and the second clothing, the pulp web is dewatered further. In this case, water from the pulp web is absorbed by the second clothing. The improvement in dewatering is particularly pronounced if the other roll is a suction roll. Conversely, a second clothing in which the water load has not been reduced by the suction roll leads to the water being drawn by suction out of the second clothing and into the pulp web formed. Dewatering of the pulp web through the suction roll is optimal because a second clothing with reduced water load results in significantly less re-wetting, whereby dewatering of the pulp web by applying suction through the suction roll is more effective.

A similarly advantageous embodiment is characterized in that the other roll and a press roll form a pressing area, the first clothing being guided through the pressing area between the pulp web and the other roll, and the second clothing being guided through the pressing area between the pulp web and the press roll. The formation of a pressing area enhances dewatering of the pulp web in the area of the other roll. Advantageously, the press roll is pressed against the other roll with a line load in the region of 10-40 kN/m.

Also disclosed is a device to produce a pulp web, in particular a tissue or sanitary paper web, according to claim 7. Here, a clothing run comprises one continuously revolving clothing and clothing guides, the respective clothing guides coming into contact with the respective revolving clothing, at least in places. Clothing guides typically comprise rolls, e.g. guide rolls, regulating rolls and tension rolls. Clothings are typically of endless design and hence form a loop. Accordingly, machine elements can be disposed inside or outside the loop. The external clothing guide of the second clothing run is disposed outside the second continuously revolving clothing forming a loop, the second clothing being wrapped partly round the external clothing guide. An arrangement of this kind enables advantageous dewatering of the pulp web formed.

A similarly advantageous embodiment of the device is characterized in that the first continuously revolving clothing is a felt and the second continuously revolving clothing is a forming fabric. Crescent formers feature a felt as first clothing and a forming fabric as second clothing. However, it is an advantage if an external clothing guide is assigned to the second clothing run, the external clothing guide being disposed between the first and second clothing in the area between the forming roll and the other roll.

Another favourable embodiment of the device is characterized in that the other roll is a suction roll. In this way, the pulp web guided on the first clothing can be dewatered to advantage, the suction effect of the suction roll acting on the first clothing, the pulp web, and then on the second clothing. Here, the suction roll has 1, 2 or 3 suction zones.

A similarly favourable embodiment of the device is characterized in that a means is provided in the area of the suction roll for applying hot air and/or steam in the direction of the suction roll, the means of applying hot air and/or steam being disposed inside the second clothing run. In interaction with the suction effect through the suction roll, hot air and/or steam is sucked into the second clothing, through the pulp web and the first clothing into the suction roll. Applying hot air and/or steam benefits dewatering through the suction roll because a temperature increase accompanies a reduction in the viscosity of the water. Here, the means of applying hot air and/or steam is disposed in the second clothing run, which is beneficial to dewatering because an effect of force (effect of pressure) on the pulp web created due to the clothing being wrapped round the suction roll results from the tension of the second revolving clothing and a temperature increase in the pulp web results from hot air and/or steam being applied, thus improving dewatering behaviour. A specialist will consider steam blow boxes, dryer hoods for delivering hot air and/or steam, or similar devices as obvious means of applying hot air and/or steam.

A particularly advantageous design of the device is characterized in that means of reducing the water load in the second revolving clothing are provided between the forming roll and the other roll. Here, the pulp web is guided on the first clothing in the area between the forming roll and the other roll and the second clothing is guided separately from the first clothing, at least in one section, the second clothing being guided over the external clothing guide of the second clothing run and the external clothing guide being disposed between the first continuously revolving clothing and the second continuously revolving clothing. Due to the water load in the second revolving clothing being reduced, the web is dewatered when the second revolving clothing is later placed on the first revolving clothing guiding the pulp web. Dewatering of the web is especially pronounced if the other roll is a suction roll. The means of reducing the water load comprise a means of dispersing a fluid, the means of dispersing being disposed outside the second clothing run. Furthermore, a specialist will identify compressed air nozzles, slotted nozzles and air blades as obvious devices for dispersing a fluid. It would make sense to use air, compressed air, hot air, process air, etc. as fluid, water being added to the fluid as an option. Adding water will reduce the temperature of the hot air. By disposing the means of dispersing outside the second clothing run and dispersing the fluid in the direction of the second clothing, the fluid will flow, in particular, not in the direction of the pulp web or the first clothing, thus dewatering the second revolving clothing without any adverse effect on the pulp web.

In a particularly advantageous embodiment, the means of dispersing a fluid is disposed in the inlet area between the external clothing guide and the second continuously revolving clothing. In this case, the fluid from the means of dispersing a fluid enters the triangular space formed by the inlet area between the external clothing guide and the second continuously revolving clothing, causing the fluid to be pressed through the second clothing in addition. This is also known as the table roll effect.

In another advantageous embodiment, the means of reducing the water load include a means of applying suction to the second continuously revolving clothing. Such means of applying suction include suction strips, suction boxes and similar.

A similarly favourable embodiment is characterized in that a press roll is disposed in the area of the other roll, the press roll being disposed inside the second clothing run and a pressing area being able to be formed by the other roll and the press roll. It is an advantage if the press roll has a rubber covering with hardness of 30-50 P&J.

BRIEF DESCRIPTION OF THE DRAWINGS

The invention will now be described using the examples in the drawings.

DETAILED DESCRIPTION

Figure 1:
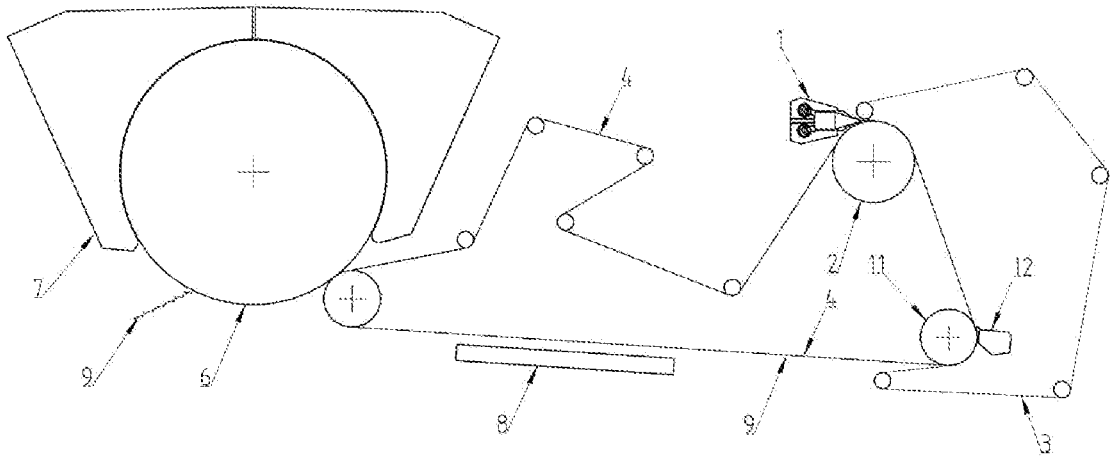
FIG. 1 shows a device for producing a pulp web according to the state of the art.

FIG. 1 shows a device for producing a pulp web 9 according to the state of the art shown in WO 2017/060053 A1. Here, a pulp suspension is fed through a headbox 1 and placed on a first revolving clothing 4 that is a felt and a second revolving clothing 3 that is a forming fabric and dewatered by centrifugal force in the area of a forming roll 2, the felt and the forming fabric being wrapped partly round the forming roll 2 and the felt being guided between the forming roll 2 and the forming fabric. The felt and the forming fabric are guided over another roll 11 directly after the forming roll 2, the other roll 1 being a suction roll and the felt and the forming fabric being wrapped partly round the other roll 11. Here, the felt is guided between the other roll 11 and the forming fabric. In order to aid dewatering at the other roll 11, a means 12 of applying hot air and/or steam can be provided, the other roll 11 then advantageously being a suction roll. The pulp web 9 is carried on the first clothing 4 after the other roll and is further dewatered. As an option, an impingement dryer 8 can be provided for thermal drying of the pulp web 9. The pulp web is transferred in a press nip from the felt to a Yankee 6, further mechanical dewatering being obtainable in the press nip. The web undergoes further thermal drying on the Yankee 6, an optional Yankee hood 7 permitting improved thermal drying. Hence, Yankee hoods 7 are typically impingement dryers. The pulp web 9 is typically removed from the Yankee 6 by creping.

Figure 2:
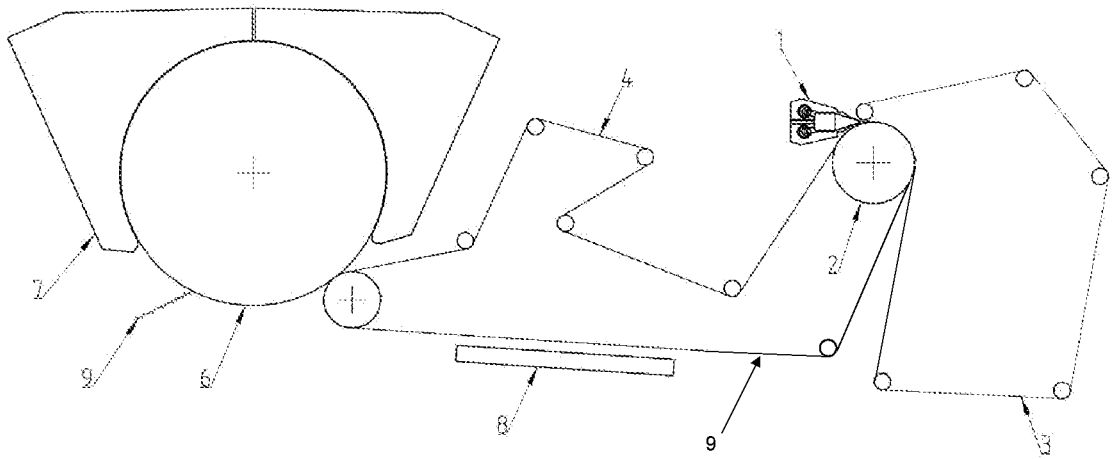
FIG. 2 shows another device for producing a pulp web according to the state of the art.

FIG. 2 shows another state-of-the-art device for producing a pulp web 9. Here, a pulp suspension is fed through a headbox 1 and placed on a first revolving clothing 4 that is a felt and a second revolving clothing 3 that is a forming fabric and dewatered by centrifugal force in the area of a forming roll 2, the felts and the forming fabric being wrapped partly round the forming roll 2 and the felt being guided between the forming roll 2 and the forming fabric. The forming fabric is lifted off the felt on the forming roll 2 or immediately after it, the pulp web 9 being carried onwards on the felt and further dewatered. As an option, an impingement dryer 8 can be provided for thermal drying of the pulp web 9. In a press nip, the pulp web is transferred from the felt to a Yankee 6, further mechanical dewatering being feasible in the press nip. The web undergoes further thermal drying on the Yankee 6, an optional Yankee hood 7 permitting improved thermal drying. Hence, Yankee hoods 7 are typically impingement dryers. The pulp web 9 is typically removed from the Yankee 6 by creping.

Figure 3:
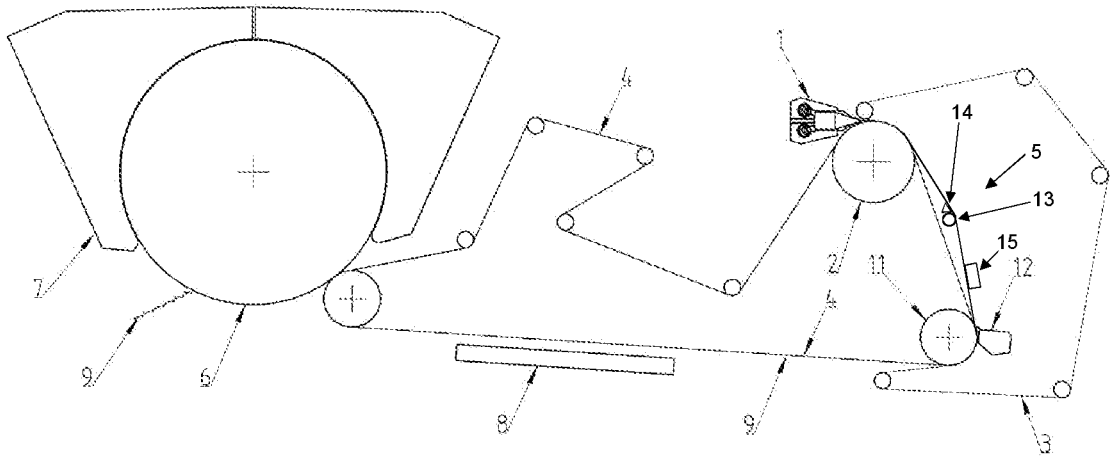
FIG. 3 shows a first device for producing a pulp web.

FIG. 3 shows a first device according to the disclosure for producing a pulp web, the pulp web 9 being, in particular, a tissue or a sanitary paper web. In order to form the pulp web 9, a pulp suspension is fed through a headbox 1 and placed between a first revolving clothing 4 that is a felt and a second revolving clothing 3 that is a forming fabric, and then dewatered by centrifugal force in the area of a forming roll 2. Here, the first clothing 4 and the second clothing 3 are wrapped partly round the forming roll 2, the first clothing 4 being guided between the forming roll 2 and the second clothing 3. The first clothing 4 and the second clothing 3 are wrapped round part of another roll 11, the first clothing 4 being guided between the other roll 11 and the second clothing 3. In particular, the pulp web 9 formed is guided between the forming roll 2 and the other roll 11 on the first clothing 4, the second clothing 3 being guided separately from the first clothing 4 between the forming roll 2 and the other roll 11, at least in one section 5. As shown in FIG. 3, the second clothing 3 is lifted off the first clothing 4 while still on the forming roll 2 and guided over the external web guide 13 of the second clothing run, the pulp web 9 being carried onward on the first clothing 4. The second clothing 3 is then placed on the first clothing 4 again on the other roll 11, the section 5 being defined as the area between the forming roll 2 and the other roll 11 where the second clothing 3 is guided separately from the first clothing 4. In this section 5, the water load in the second clothing 3 guided separately is reduced by various means of reducing the water load, the means of reducing the water load comprising means 14 of dispersing a fluid and/or means 15 of applying suction to the second continuously revolving clothing 3. The means 14 of dispersing a fluid is disposed advantageously outside the second clothing run, where it makes sense to use air, compressed air, hot air, process air, etc., as fluid, and a specialist would consider compressed air nozzles, slotted nozzles and air blades as obvious such devices 14 for dispersing a fluid. Similarly, it is an advantage to dispose the means 14 of dispersing a fluid in the inlet area between the external clothing guide 13 and the second continuously revolving clothing 3. The means 15 of applying suction to the second continuously revolving clothing comprise suction strips, suction boxes, or similar. Advantageously, the other roll 11 is a suction roll, hot air and/or steam being applied optionally to the forming fabric through a means of applying hot air and/air steam and the suction roll drawing the hot air and/or steam by suction through the forming fabric in the direction of the pulp web 9. According to the invention, the pulp web 9 is carried on the first clothing 4 after the other roll 11 and further dewatered mechanically and/or thermally.

Figure 4:
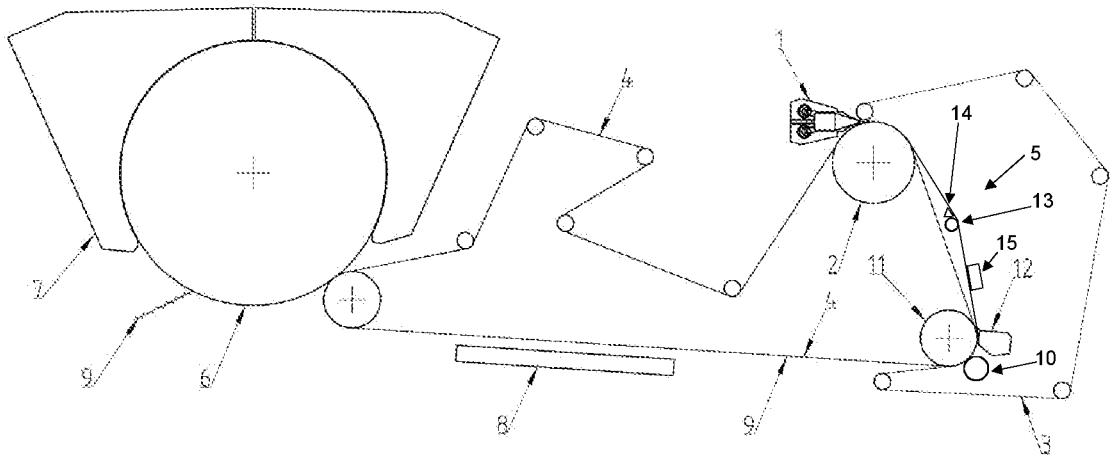
FIG. 4 shows a second device for producing a pulp web.

FIG. 4 shows a second device according to the invention for producing a pulp web. Compared to the illustration of the first device according to the invention in FIG. 3, the illustration of the second device according to the invention in FIG. 4 differs particularly in that a press roll 10 is disposed in the area of the other roll 11 inside the second clothing run, a pressing area being able to be formed by the other roll 11 and the press roll 10, and the first revolving clothing, the pulp web 9 and the second revolving clothing 3 being guided through the pressing area. The other explanations relating to the first device according to the invention in FIG. 3 also apply to the second device according to the invention in FIG. 4.

Figure 5:
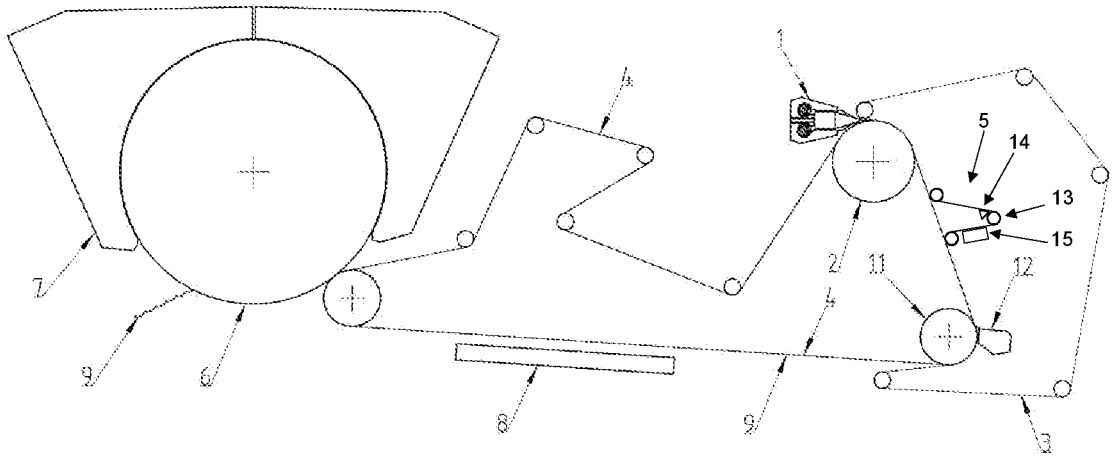
FIG. 5 shows a third device for producing a pulp web.

FIG. 5 shows a third device according to the invention for producing a pulp web. Compared to the illustration of the first device according to the invention in FIG. 3, the illustration of the third device according to the invention in FIG.

5 differs particularly in that the second clothing 3 is not lifted off the first clothing 4 until after the forming roll 2 and is guided over the external web guide 13 of the second clothing run, the pulp web 9 being guided onward on the first clothing 4. The second clothing 3 is then placed on the first clothing 4 again before the other roll 11, the section 5 being defined as the area between the forming roll 2 and the other roll 1 in which the second clothing 3 is guided separately from the first clothing 4. The other explanations relating to the first device according to the invention in FIG. 3 also apply to the third device according to the invention in FIG. 5.

The inventive embodiments thus offer numerous advantages. They provide optimized production of a pulp web with significantly improved dewatering of the pulp web in the area between the forming roll and the other roll. In particular, this significant improvement in dewatering of the pulp web can be achieved by simple means, such as means of dispersing a fluid, the fluid enabling a reduction in the water load of the second revolving clothing and, in consequence, a significant improvement in dewatering of the pulp web at the other roll. In this way, overall energy consumption compared to state-of-the-art solutions can be reduced. In addition, the solution according to the invention enables these benefits to be achieved with low investment costs, two revolving clothings, i.e. a first and a second, being sufficient to achieve this. Furthermore, the invention provides an improvement in the quality characteristics of the pulp web, such as its bulk or caliper, because the improvement in dewatering of the pulp web enables improved ability to achieve these quality characteristics in subsequent drying of the pulp web, particularly in subsequent mechanical pressing.

REFERENCE NUMERALS (1) Headbox
(2) Forming roll
(3) Second revolving clothing, forming fabric
(4) First revolving clothing, felt
(5) Section
(6) Yankee
(7) Yankee hood
(8) Impingement dryer
(9) Pulp web
(10) Press roll
(11) Other roll
(12) Means of applying hot air and/or steam
(13) External clothing guide
(14) Means of dispersing a fluid
(15) Means of applying suction

The invention claimed is:

1. A device for producing a pulp web (9), comprising:
a headbox (1),
a first clothing run comprising a continuously revolving clothing (4) and first clothing guides, and defining an inside and an outside,
a second clothing run comprising a second continuously revolving clothing (3) and second clothing guides, and defining an inside and an outside,
a forming roll (2) disposed on the inside of the first continuously revolving clothing (4),
at least one other roll (11) disposed on the inside of the first continuously revolving clothing (4),
an external clothing guide (13), and
a means for reducing a water load in the second revolving clothing (3) provided between the forming roll (2) and the other roll (11), wherein
the first continuously revolving clothing (4) is wrapped partly around the forming roll (2) and the other roll (11) with the forming roll (2) and the other roll (11) disposed on the outside of the second continuously revolving clothing (3),
the second continuously revolving clothing (3) is wrapped partly around the forming roll (2) and the other roll (11),
the first continuously revolving clothing (4) is disposed between the second continuously revolving clothing (3) and the forming roll (2),
the first continuously revolving clothing (4) is disposed between the second continuously revolving clothing (3) and the other roll (11) and between the forming roll (2) and the headbox (1) for placing a pulp suspension between the first continuously revolving clothing (4) and the second continuously revolving clothing (3),
the second clothing run has the external clothing guide (13) positioned between the forming roll (2) and the other roll (11) to guide the second continuously revolving clothing (3) separately from the first continuously revolving clothing (4) in a section between the forming roll (2) and the other roll (11),
the external clothing guide (13) is disposed on the outside of the second continuously revolving clothing (3),
the external clothing guide (13) is disposed between the first continuously revolving clothing (4) and the second continuously revolving clothing (3), and
the water load is reduced in the section of the second continuously revolving clothing (3) that is separately guided between the forming roll (2) and the other roll (11) by the means for reducing a water load.

2. The device according to claim 1, wherein the first continuously revolving clothing (4) is a felt and the second continuously revolving clothing (3) is a forming fabric.

3. The device according to claim 1, wherein the other roll (11) is a suction roll.

4. The device according to claim 3, comprising a steam blow box or a dryer hood provided in an area of the other roll (11) configured to apply one or both of hot air and steam in a direction toward the other roll (11), wherein the steam blow box or dryer hood is disposed on the inside of the second clothing run.

5. The device according to claim 1, wherein the means for reducing a water load is configured as one or more of suction strips, suction boxes, air nozzles, slotted nozzles and air blades provided between the forming roll (2) and the other roll (11) and configured to reduce the water load in the section of the second continuously revolving clothing (3) that is separately guided.

6. The device according to claim 5, wherein the means for reducing water load comprises one or more of suction strips, suction boxes, air nozzles, slotted nozzles and air blades disposed for dispersion on the outside of the second clothing run.

7. The device according to claim 6, wherein the means for reducing a water load comprises one or more of suction strips, suction boxes, air nozzles, slotted nozzles and air blades disposed in an inlet area between the external clothing guide (13) and the second continuously revolving clothing (3).

8. The device according to claim 5, wherein the means for reducing a water load comprises one or both of suction strips and suction boxes provided between the forming roll (2) and the other roll (11) and configured for applying suction to the second continuously revolving clothing (3) in the section of the second continuously revolving clothing (3) that is separately guided.

9. The device according to claim 1, comprising a press roll (10) disposed on the inside of the second clothing run in an area of the other roll (11), thereby forming a pressing area with the other roll (11).

10. The device according to claim 1, wherein the means for reducing a water load comprises one or both of suction strips and suction boxes provided between the forming roll (2) and the other roll (11) and configured for applying suction to the second continuously revolving clothing (3) in the section of the second continuously revolving clothing (3) that is separately guided.

11. The device according to claim 6, wherein the means for reducing a water load additionally comprises one or both of suction strips and suction boxes provided between the forming roll (2) and the other roll (11) and configured for applying suction to the second continuously revolving clothing (3) in the section of the second continuously revolving clothing (3) that is separately guided.

12. The device according to claim 7, wherein the means for reducing a water load additionally comprises one or both of suction strips and suction boxes provided between the forming roll (2) and the other roll (11) and configured for applying suction to the second continuously revolving clothing (3) in the section of the second continuously revolving clothing (3) that is separately guided.

* * * * *